United States Patent [19]

Gangi

[11] 4,086,792

[45] May 2, 1978

[54] WEFT INLAY RACKING CONTROL

[75] Inventor: Robert J. Gangi, Emerson, N.J.

[73] Assignee: Joan Manufacturing Corporation, Waldwick, N.J.

[21] Appl. No.: 821,616

[22] Filed: Aug. 3, 1977

[51] Int. Cl.[2] ..... D04B 27/26

[52] U.S. Cl. ..... 66/207

[58] Field of Search ..... 66/85 R, 204, 207, 127

[56] References Cited

U.S. PATENT DOCUMENTS

| | | | |
|---|---|---|---|
| 3,350,901 | 11/1967 | Noe | 66/207 |
| 3,447,344 | 6/1969 | Zwingenberger | 66/207 |
| 3,469,420 | 9/1969 | Noe | 66/207 |
| 3,563,060 | 2/1971 | Titone | 66/207 |

FOREIGN PATENT DOCUMENTS

| | | | |
|---|---|---|---|
| 6,609,775 | 1/1967 | Netherlands | 66/207 |

*Primary Examiner*—Henry S. Jaudon

*Attorney, Agent, or Firm*—Bell, Seltzer, Park & Gibson

[57] ABSTRACT

This racking control is particularly adapted for warp knitting machines of the type including weft inlay yarn feed tubes to which a limited range of step-by-step racking movements may be imparted to produce zig-zag striping, diamonds and various other motifs in the knit fabric. The present racking control is utilized to substantially increase the normally limited racking movement to thereby increase the size of such motifs which may be formed in the knit fabric. The normal amount of limited racking movement is imparted by a main pattern chain acting on a main carrier rod and an auxiliary carrier rod is selectively latched to the main carrier rod for providing additional racking movement by means of an auxiliary pattern chain.

6 Claims, 4 Drawing Figures

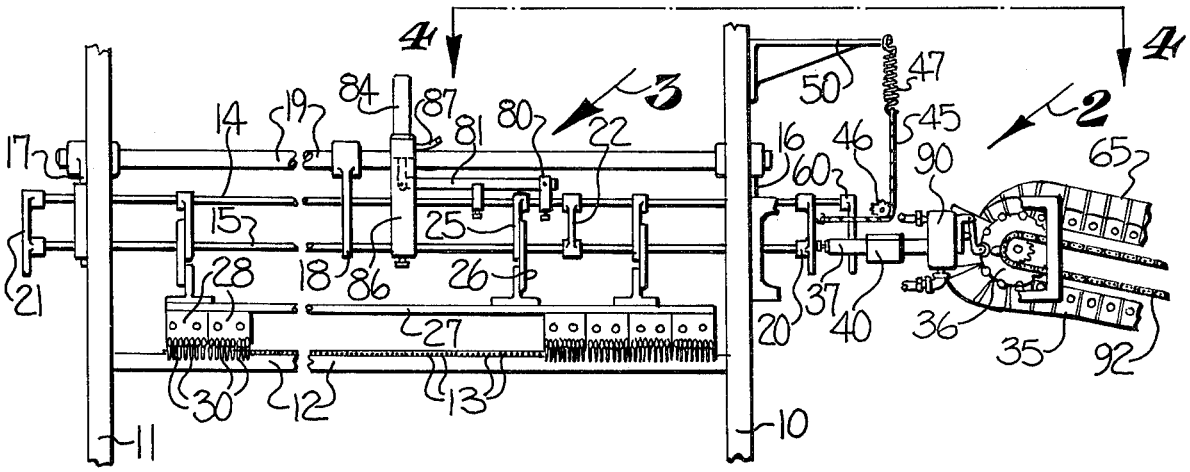
Fig-1
Fig-4
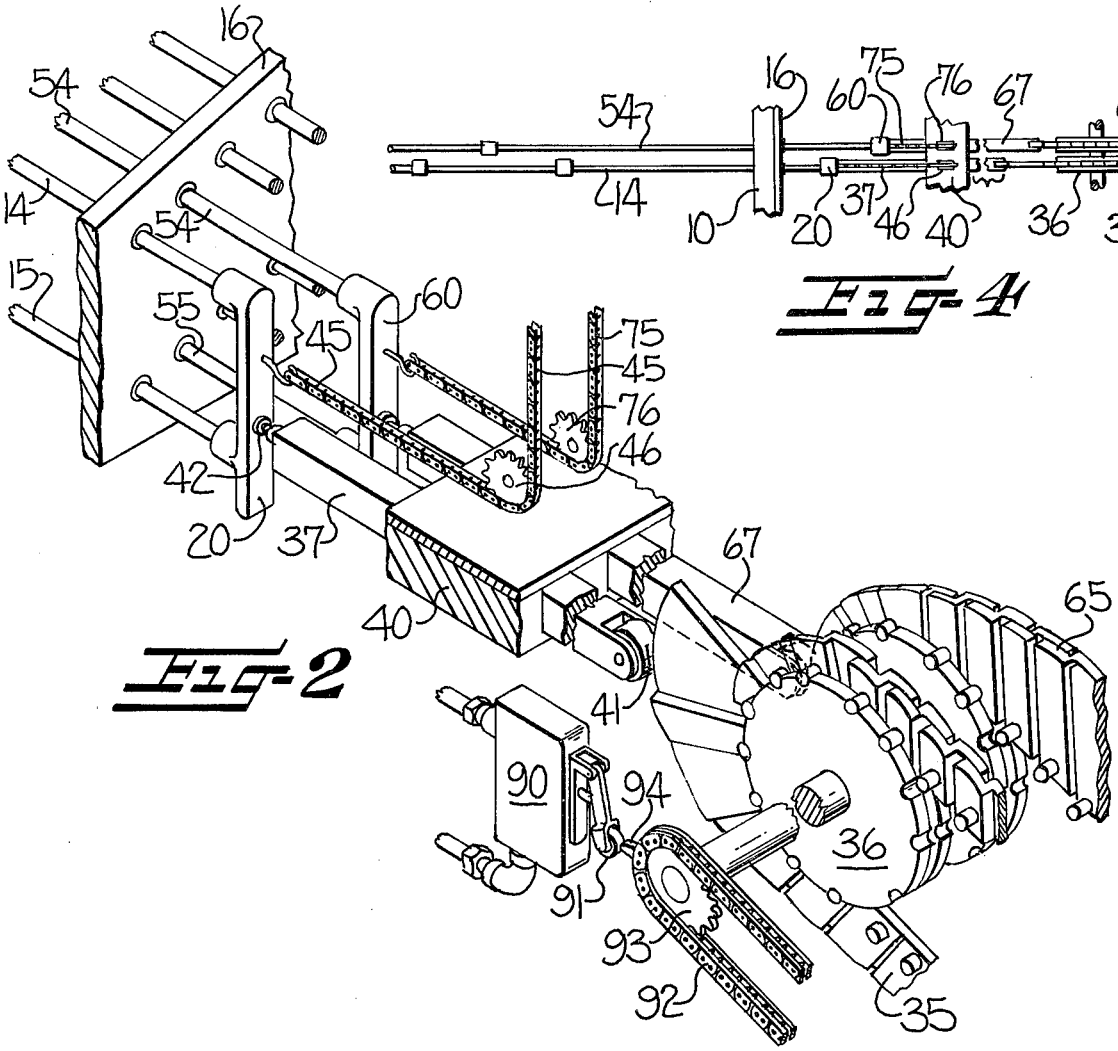
Fig-2

WEFT INLAY RACKING CONTROL

This invention relates generally to a weft inlay racking control for warp knitting machines and more particularly to such a control which may be used for increasing the normally limited racking movement of the weft inlay yarn feed tubes so as to greatly expand the pattern possibilities of the knitting machine.

The racking or shogging of the weft inlay tubes of a warp knitting machine is usually controled by a pattern chain which inparts step-by-step longitudinal racking movement to a carrier rod supporting the weft inlay yarn feed tubes. The amount of racking movement of the weft inlay yarn tubes is normally limited to the difference between the short and high links or knuckles of the pattern chain. Heretofore, the limit of racking movement of the weft inlay yarn tubes has been approximately 2 inches because it is not practical to use a chain having links of greater height. Thus, the patterns which may be knit on such a machine are limited to a staggered back-and-forth design with the racking movement being limited to 2 inches of movement of the weft inlay yarn feed tubes in either direction.

In an attempt to increase this limited racking movement of the weft inlay yarn guide tubes, it has been proposed to replace the pattern chain with a pin chain. However, this pin type of chain must be reciprocated inwardly and outwardly in timed relationship to the knitting of the courses of the fabric and this requires that the speed of operation of the knitting machine be substantially reduced.

With the foregoing in mind, it is an object of the present invention to provide a weft inlay racking control for a weft knitting machine which utilizes the usual pattern chain to permit the high speed operation of the machine and which substantially increases the normally limited racking movement of the weft inlay yarn feed tubes.

In accordance with the present invention, a limited range of step-by-step racking movement is imparted to the main carrier rod supporting the weft inlay yarn feed tubes by the usual pattern chain and an auxiliary carrier rod is supported adjacent the main carrier rod for parallel movement. An auxiliary pattern chain is employed for imparting a limited range of movement to the auxiliary carrier rod and latch means is provided for selectively engaging the auxiliary carrier rod with the main carrier rod for transmitting additional racking movement to the first carrier rod after the first carrier rod has reached the end of its limited racking movement so as to thereby substantially increase the amount of racking movement which may be imparted to the first carrier rod. Control means is also provided for selectively operating the latch means so that the control of the racking movement of the weft inlay yarn tubes is effected by the first pattern chain throughout a limited range of movement and then this limited range of movement is increased by means of the second pattern chain so that the entire range of racking movement is increased in both directions.

Other objects and advantages will appear as the description proceeds when taken in connection with the accompanying drawings, in which FIG. 1 is a somewhat schematic fragmentary front elevational view of the weft knitting machine and illustrating the present racking control associated therewith;

FIG. 2 is an enlarged fragmentary isometric view looking inwardly at the right-hand end of FIG. 1 and in the direction of the arrow 2 in FIG. 1;

FIG. 4 is a fragmentary schematic plan view of the main and auxiliary carrier rods, being taken substantially along the Line 4—4 in FIG. 1.

Figure 3:
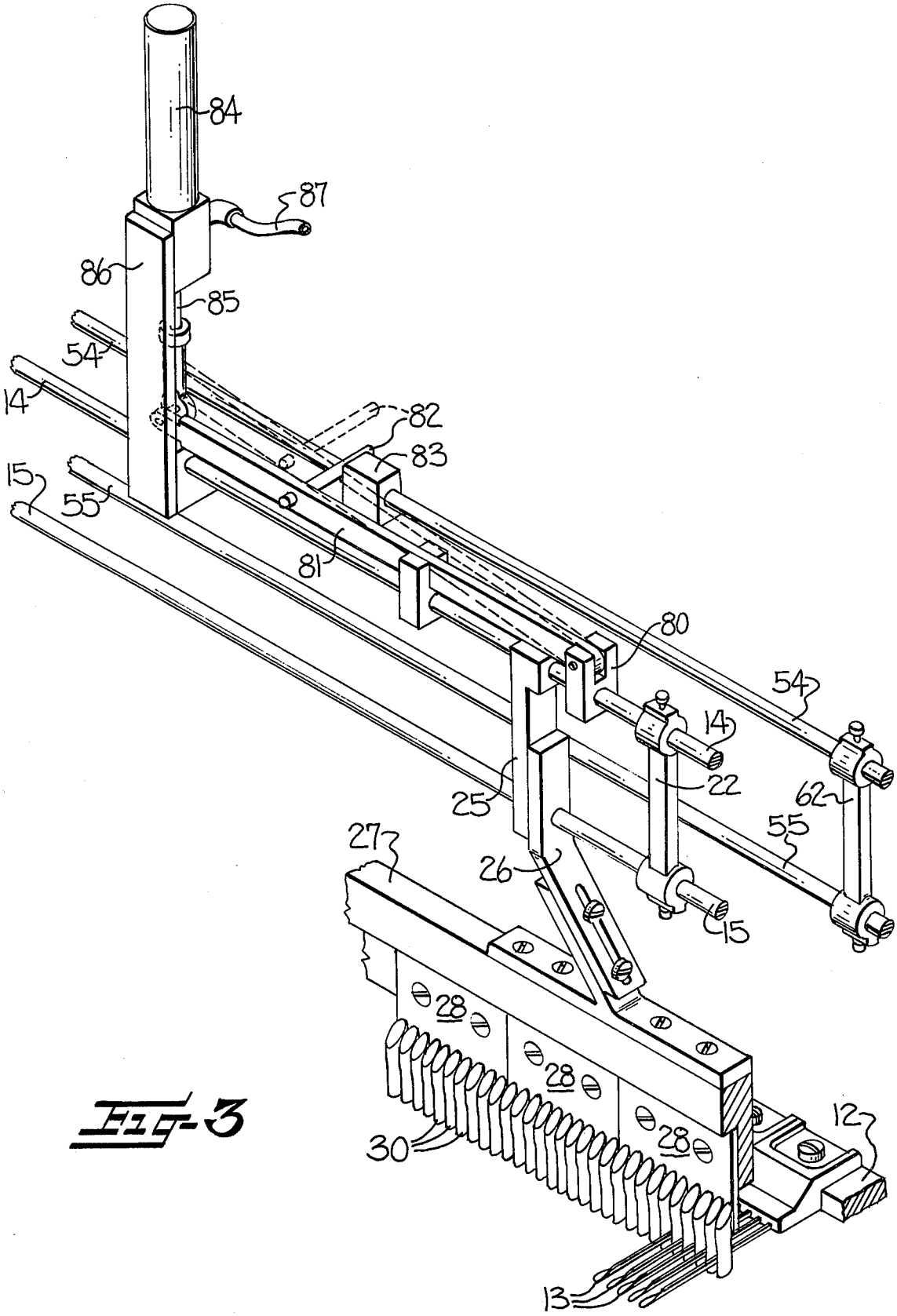
FIG. 3 is an enlarged isometric view of the latching means, looking in the direction of arrow 3 in FIG. 1.

The racking control of the present invention is illustrated in association with a conventional warp knitting machine of the type manufactured by Cidega Machine Corporation. This type machine is adapted to form a base or ground fabric including interconnected parallel warp stitch chains which are formed by wrap yarns fed to the needles with each reciprocation thereof. The fabric may also be provided with weft inlay yarns which are interconnected with the warp stitch chains to provide various staggered back-and-forth patterns on one face of the knit fabric. However, it is to be understood that the present inlay yarn racking control may be utilized in connection with other types of warp knitting machines.

As illustrated in the drawings, the warp knitting machine includes a pair of opposite end frames 10, 11 (FIG. 1) with a transversely extending needle bed 12 supported therebetween. A row of needles 13 (FIG. 3) is supported for horizontal reciprocation in the needle bed 12. First carrier rod means, in the form of a pair of carrier rods 14, 15, is supported for longitudinal movement in carrier guide plates 16, 17 supported for vertical reciprocation on the respective end frames 10, 11. The carrier rods 14, 15 are supported for longitudinal movement intermediate their ends in one or more intermediate carrier guide plates 18 (FIG. 1). The carrier guide plates 16, 17, 18 are supported at their upper ends on a support shaft 19 which extends between the end frames 10, 11. Opposite ends of the carrier rods 14, 15 are fixed in end brackets 20, 21 and the medial portions of the carrier rods 14, 15 are connected by connector brackets 22.

Weft inlay yarn feed means is carried by the first carrier rod means and, as best illustrated in FIG. 3, includes a support bracket 25 fixed between the carrier rods 14, 15. A support arm 26 is fixed at its upper end on the support bracket 25 and its lower end supports a weft inlay bar 27. Profile plates 28 are fixed to the weft inlay bar 27 and a plurality of weft inlay yarn feed tubes 30 are fixed thereto.

The needles 13 are horizontally reciprocated as warp yarns, not shown, are fed thereto to knit successive courses of the ground or base fabric in the usual manner. The weft inlay yarn feed tubes 30 have step-by-step racking movement imparted thereto, in a manner to be presently described, so that the weft inlay yarns form staggered back-and-forth designs, such as zig-zag stripes, diamonds and the like on one face of the knit fabric. To this end, a first pattern chain 35 (FIG. 2) passes over and is driven by a chain drum 36 which is rotated in timed relationship and in a step-by-step manner with operation of the needles 13. The chain 35 is made up of interconnected links or knuckles which vary in height or length (FIG. 2). A push bar or rod 37 is supported for sliding movement intermediate its ends in a slide block 40 and the outer end of the push rod 37 is provided with a chain roller 41 which rides on the pattern chain 35. The opposite end of the push rod 37 is provided with an adjustable abutment 42 which engages the end bracket 20 of the carrier rods 14, 15.

Means is provided for resiliently urging the main carrier rods 14, 15 into engagement with the end of the push rod 37 and includes a chain 45 suitably connected at one end to the end bracket 20. The chain 45 passes around a sprocket 46 and the upper end of the chain 45 is connected to the lower end of a tension spring 47 (FIG. 1), the upper end of which is fixed on a spring perch 50. Thus, the chain roller 41 is resiliently maintained in engagement with the links of the pattern chain 35 and the height of the particular link which is in engagement with the chain roller 41 determines the longitudinal position of the carrier rods 14, 15, as well as the weft inlay yarn guides tubes 30 which are carried thereby. The pattern chain 35 is thus utilized to impart a limited range of step-by-step racking movement to the carrier rods 14, 15 and the weft inlay yarn feed tubes 30 carried thereby. This range of racking movement is limited by the difference between the high and low links which may be employed in the pattern chain 35. Normally, the links of the pattern chain 35 may provide a range of racking movement of approximately 2 inches and if chain links of greater height are employed, they are difficult to maintain in alignment with the chain drum.

In accordance with the present invention, means is provided for increasing the limited racking movement of the carrier rods 14, 15 and of the weft inlay yarn feed tubes 30 and includes auxiliary carrier rod means supported adjacent the first carrier rods means for parallel movement relative to the needles and the first carrier rods. The auxiliary carrier rod means includes a pair of carrier rods 54, 55 which are supported for longitudinal movement adjacent opposite ends in the guide plates 16, 17 and intermediate their ends in one or more carrier guide plates 18. Opposed ends of the carrier rods 54, 55 are fixed in end brackets 60 and are fixed intermediate their ends by one or more intermediate connector brackets 62 (FIG. 3).

A second pattern chain 65 is also supported on the chain drum 36 and in side-by-side spaced relationship with the first pattern chain 35. A push bar or rod 67 is supported in the slide block 40 with the outer end being normally in engagement with the second pattern chain 65 and the inner end being adapted to engage the end bracket 60 on the right-hand end of the carrier rods 54, 55. Resilient means is provided for urging the carrier rods 54, 55 to their extreme right-hand position and includes a chain 75, one end of which is connected to the end bracket 60. The chain 75 passes over a sprocket 76 and its other end is connected to a tension spring, similar to the tension spring 47.

Latch means is provided for selectively engaging the auxiliary carrier rods 54, 55 with the first carrier rods 14, 15 for transmitting additional racking movement thereto after the first carrier rods 14, 15 have reached the end of their limited transverse racking range by means of the pattern chain 35. The latch means (FIG. 3) includes a pivot block 80 fixed on the carrier rod 14 and providing a pivotal support for one end of a latch lever 81 which extends parallel to and above the carrier rod 14. A latch pin 82 is fixed in one end of the latch lever 81 and extends outwardly at right angles therefrom and across the auxiliary carrier rod 54. Abutment means in the form of adjustable stop block 83 is fixed on the carrier rod 54 and is adapted to engage the latch pin 82, in a manner to be presently described. Operator means is operatively associated with the other end of the latch lever 81 and includes an air cylinder 84 having a piston rod 85 connected at its lower end to the free end of the latch lever 81. A support bracket 86 is fixed on the carrier rod 14 and maintains the air cylinder 84 in a fixed position thereabove. An air supply line 87 is connected to the air cylinder 84 to operate the same, in a manner to be presently described.

Control means is provided for selectively operating the latch means and includes an air pressure control switch 90 (FIG. 2) which is supported on the frame of the machine and includes a operating arm roller 91 aligned with a pattern chain 92. The pattern chain 92 is driven by a sprocket 93 which is fixed on the shaft of the chain drum 36 and rotates in a step-by-step manner therewith. Pattern lugs 94 are spaced along the pattern chain 92 (FIG. 2) to control operation of the switch 90 and the air cylinder 84.

With the chain drum 36 moving in a counterclockwise step-by-step manner, as illustrated in FIG. 2, and with the latch lever 81 and latch pin 82 in the raised or dotted line position (FIG. 3) the carrier rods 14, 15 and the weft yarn inlay feed tubes 30 carried thereby will have been racked to the extreme left-hand position which they could normally be moved to by the pattern chain 35 so that the slide bar roller 41 is positioned on the highest pattern link of the chain 35.

When this racking limit has been reached, the abutment 94 on the pattern chain 92 engages the roller 91 and operates the switch 90 so that the air cylinder 84 moves the latch lever 81 and latch pin 82 downwardly to the solid line position so that the latch pin 82 is positioned in front of the abutment 83 carried by the carrier rod 54 (FIG. 3). At this time, the push rod 67 is positioned on a low link of the pattern chain 65 (FIG. 2). Step-by-step racking movement is then imparted to the auxiliary carrier rods 54, 55 so that the abutment 83 moves the latch pin 82 to the left in a step-by-step racking movement to thereby impart additional racking movement to the yarn feed tubes 30 for an additional 2 inches, if desired.

When the auxiliary carrier rods 54, 55 have been racked to the extreme left-hand position which is permitted by the high links on the pattern chain 65, the height of the links of the chain 65 will be gradually reduced so that both the auxiliary carrier rods and the first carrier rods will be racked left to right in a step-by-step manner. When the additional movement is imparted to the auxiliary carrier rods 54, 55 by the pattern chain 65, the chain roller 41 of the push rod 37 will move away from the pattern chain 35, as schematically illustrated in FIG. 4.

When a low link on the pattern chain 65 has been reached, the roller 41 on the push rod 37 will be positioned on a high link of the chain 35 and another abutment 94 on the pattern chain 92 will engage the switch 90 and operate the air cylinder 84. The latch lever 81 will be raised so that the latch pin 82 is raised to the dotted line position and further racking movement is imparted to the carrier rods 14, 15 by gradually reducing the height of the links on the chain 35.

Thus, the weft inlay racking control of the present invention increases the normal racking stroke of the weft yarn inlay tubes 30 by imparting the normal maximum 2-inch racking movement to the first carrier rods 14, 15 by means of the first pattern chain 35 until the maximum racking stroke has been reached. Then, additional racking movement is imparted to the yarn feed tubes 30 by means of the movement of the auxiliary carrier rods 54, 55 from links on the second pattern chain 65. Although two pattern chains are shown in the present application, it is to be understood that additional pattern chains and carrier rods could be utilized to further increase the stroke of racking movement of the weft yarn inlay tubes 30, if desired.

The increase in the racking range of the weft inlay yarn guide tubes 30 is obtained in accordance with the racking control of the present invention without requiring a reduction in the speed of operation of the knitting machine. Also, the racking control of the present invention may be added to conventional warp knitting machines without requiring major modifications thereof.

In the drawings and specifications there has been set forth a preferred embodiment of the invention, and although specific terms are employed, they are used in a generic and descriptive sense only and not for purposes of limitation, the scope of the invention being defined in the claims.

That which is claimed is:

1. In a warp knitting machine including a row of needles, first carrier rod means supported for parallel movement relative to said needles, weft inlay yarn feed means carried by said first carrier rod means, and a first pattern chain for imparting a limited range of step-by-step racking movement to said carrier rod means for inlaying weft yarns over a limited transverse range across the knit fabric, the combination therewith of means for increasing said limited racking movement of said first carrier rod means, said means comprising (a) auxiliary carrier rod means supported adjacent said first carrier rod means for parallel movement relative to said needles and said first carrier rod means, (b) a second pattern chain for imparting a limited range of racking movement to said auxiliary carrier rod means, (c) latch means for selectively engaging said auxiliary carrier rod means with said first carrier rod means for transmitting additional racking movement to said first carrier rod means after said first carrier rod means has reached the end of its limited transverse range, and (d) control means for selectively operating said latch means.

2. A warp knitting machine according to claim 1 including a pair of end frames at opposite ends of said row of needles, and a chain drum supported adjacent one of said end frames and being operated in a step-by-step manner in timed relationship to operation of said row of needles, said first and second pattern chains being supported in side-by-side relationship on said chain drum movement thereby.

3. A warp knitting machine according to claim 2 including first and second push bars having corresponding ends in engagement with said respective first and second pattern chains and with the other ends being adapted to engage the corresponding ends of said first and said auxiliary carrier rod means, and resilient means normally urging said carrier rod means into engagement with said push bars and said push bars into engagement with said pattern chains.

4. A warp knitting machine according to claim 1 wherein said latch means comprises a pivot block carried by said first carrier rod means, a latch lever pivotally supported at one end in said pivot block and extending parallel to said first carrier rod means, a latch pin supported in one end in said latch lever and extending at substantially right angles therefrom and across said auxiliary carrier rod means, operator means operatively associated with the other end of said latch lever and operable to selectively move said latch lever and said latch pin between a raised inoperative position and a lowered operative position, and abutment means carried by said auxiliary carrier rod for engagement with said latch pin when said latch lever is in the lowered operative position so that step-by-step movement imparted to said auxiliary carrier rod means is imparted to said first carrier rod means.

5. A warp knitting machine according to claim 4 wherein said operator means comprises a fluid cylinder supported by said first carrier rod means and being operatively connected to said latch lever.

6. A warp knitting machine according to claim 1 wherein said control means comprises a chain with pattern lugs carried thereby, and including switch means operable by said pattern lugs for controlling the operation of said latch means.

* * * * *